US005435012A

United States Patent [19]

Lincoln

[11] Patent Number: 5,435,012

[45] Date of Patent: * Jul. 25, 1995

[54] SUN-SHIELDING VENTILATED GLOVE

[76] Inventor: Robert A. Lincoln, 8325 Murphy Rd., Laurel, Md. 20723

[ * ] Notice: The portion of the term of this patent subsequent to Jun. 30, 2009 has been disclaimed.

[21] Appl. No.: 907,738

[22] Filed: Jun. 29, 1992

Related U.S. Application Data

[63] Continuation-in-part of Ser. No. 478,916, Feb. 12, 1990, Pat. No. 5,125,115.

[51] Int. Cl.[6] ..... A41D 19/00

[52] U.S. Cl. ..... 2/159

[58] Field of Search ..... 2/159, 16, 161, 161.1, 2/161.6, 163, 167, 20

[56] References Cited

U.S. PATENT DOCUMENTS

| | | | |
|---|---|---|---|
| 356,385 | 1/1887 | Waterhouse | 2/20 X |
| 613,847 | 11/1898 | Rue | 2/16 |
| 922,237 | 5/1909 | Baggett | 2/161.6 |
| 1,486,006 | 3/1924 | Blom | 2/20 X |
| 5,125,115 | 6/1992 | Lincoln | 2/159 |

FOREIGN PATENT DOCUMENTS

| | | | |
|---|---|---|---|
| 4091201 | 3/1992 | Japan | 2/16 |
| 4126806 | 4/1992 | Japan | 2/16 |

*Primary Examiner*—Clifford D. Crowder
*Assistant Examiner*—Paul C. Lewis

[57] ABSTRACT

The invention is a glove-like device which shields the back of the hands from the rays of sunlight. It fits over the back of the hand like a glove, but leaves the palm and sides of the hand and the sides of the fingers and thumb essentially uncovered so heat from the hand can easily escape and the hand can be cooler. Unlike ordinary gloves which would be too uncomfortable to be worn in warm or hot surroundings because they retain the heat coming from the hands, the invention provides ventilation for the hands and allows them to stay cool while the device is being worn in the hot summer sun, or in warm surroundings, such as the inside of an air conditioned automobile, where one would not want to wear ordinary gloves to shield the sunlight off the hands. The sun-shielding device is held on the hand by portions which slip over the ends of the fingers and the thumb, strips of material which go around the fingers and thumb, one or more strips which go across the palm of the hand, and an adjustable band which goes around the wrist. The shield portion over the back of the hand can be made of various materials which block the passage of rays of sunlight. The portion that wraps around the palm side to hold the device on the hand can be made of various materials which will hold the shield portion in place while allowing heat to escape freely from around the palm side of the hand. The device also allows heat to escape from under the shield as the hand is flexed during normal movement or grasping.

15 Claims, 10 Drawing Sheets

SUN-SHIELDING VENTILATED GLOVE

CROSS REFERENCE TO RELATED APPLICATION

This application is a continuation-in-part of U.S. patent application Ser. No. 07/478,916, filed Feb. 12, 1990, now U.S. Pat. No. 5,125,115.

BACKGROUND OF THE INVENTION

Hand coverings or gloves have been used by people as long ago as recorded time, and probably since people began to wear animal skin or other body coverings for protection.

Many gloves can do the same thing, but some gloves do something better or differently than others. Most gloves are designed to do one or two things. One thing that most gloves do as their primary purpose or as an added effect is to make the hands warmer than they would be if the gloves were not worn.

Many special-purpose gloves have been developed. For example, gloves to keep warm, to protect from heat or sparks, to aid in holding a golf club or ball bat, or to provide assistance in swimming.

Most gloves protect the hands from the elements, substances, atmosphere, or environment surrounding them. However, there are no gloves which protect the hands from sunlight while at the same time allowing them to be cool when the gloves are worn in a warm environment—unless one were to add a coolant to the gloves.

The effect of sunlight on the skin of the human body is becoming increasingly more important as the atmospheric shield of the earth is becoming less effective in screening out harmful rays of light and such light reaches the surface of the earth and the people inhabiting it.

During normal everyday activity when the usual everyday clothes are being worn, two parts of the body are subject to greater exposure than any other parts. They are the hands and the face. Of these two parts, the face gets the greater protection in warmer climates where gloves are not normally worn as a part of the usual outdoors clothing, either all year or during that part of the year when the temperature is warmer. The face is protected from the sunlight by hat brims, cap visors, the angles of the sunlight striking at lesser degrees, by ones turning the face downward away from the sun, by one's hair, etc. During these normal conditions, the one part of the body left unprotected is the hand or hands. Nothing much has been done to protect the hands from sunlight. During warm or hot seasons when the sunlight is most intense, gloves are usually not worn because they cause the hands to overheat, sweat, and become uncomfortable. Thus, the hands are unprotected from the harmful rays of sunlight. My invention greatly reduces the heat retention of the gloves and thus eliminates the discomfort of wearing gloves when the temperature of the air around the body is warm or hot.

The sunlight does not strike all parts of the hands in an equal amount. More light rays hit the backs of the hands. In fact, very little hits the palm side of the hands, as they are normally turned away from the sun. When one walks, the hands are at the sides of the body with the palms turned toward the body. When one runs, the hands are clenched and the backs of the hands are exposed to sunlight. When one holds a hammer or other handtool, the hand wraps around the tool and the back of the hand is exposed to the direct sunlight. When one drives an automobile, the hands grip around the steering wheel and the backs of the hands are exposed to the sunlight. In doing almost any normal activity the backs of the hands are the parts that are exposed to the direct sunlight because of the way the hands are attached to the body and because of the way they hold things.

SUMMARY OF THE INVENTION

My invention is a device or glove which protects the hands from the light of the sun while at the same time it keeps the hands from getting hotter because it allows most of the heat coming out of the body to escape, and disallows heat from the sun to be absorbed by the hands. The invention allows one to have ventilation of the hand surface while at the same time protecting the back of the hand from exposure to direct sunlight.

My invention utilizes a fabric, reflective film, or other material which is capable of reflecting, blocking, resisting, or reducing the passage of sunlight to cover the back of the hands, and combines that portion with a portion which goes over the other side or palm portion of the hands to hold the device on the hands. The portion which goes over or across the palm side of the hands is minimized to the extent considered necessary to achieve the ventilation desired while taking into consideration other purposes one might wish to achieve. Thus, if one wanted to grip something tightly and wanted a degree of protection for the palm, one could use an open mesh made of leather or strong fabric. If one wanted to do things such as walking, running, or driving, one could have the palm almost completely uncovered. If one desired the glove to be held more securely on the hand, a strip or two going across the palm could be added.

The greatest use of my invention is for protecting the hands, because they receive the greatest exposure to sunlight. However, the device can be enlarged or extended to cover the wrists and the arms, because they too may be exposed to too much sunlight.

DESCRIPTION OF THE PREFERRED EMBODIMENTS

Figure 1:
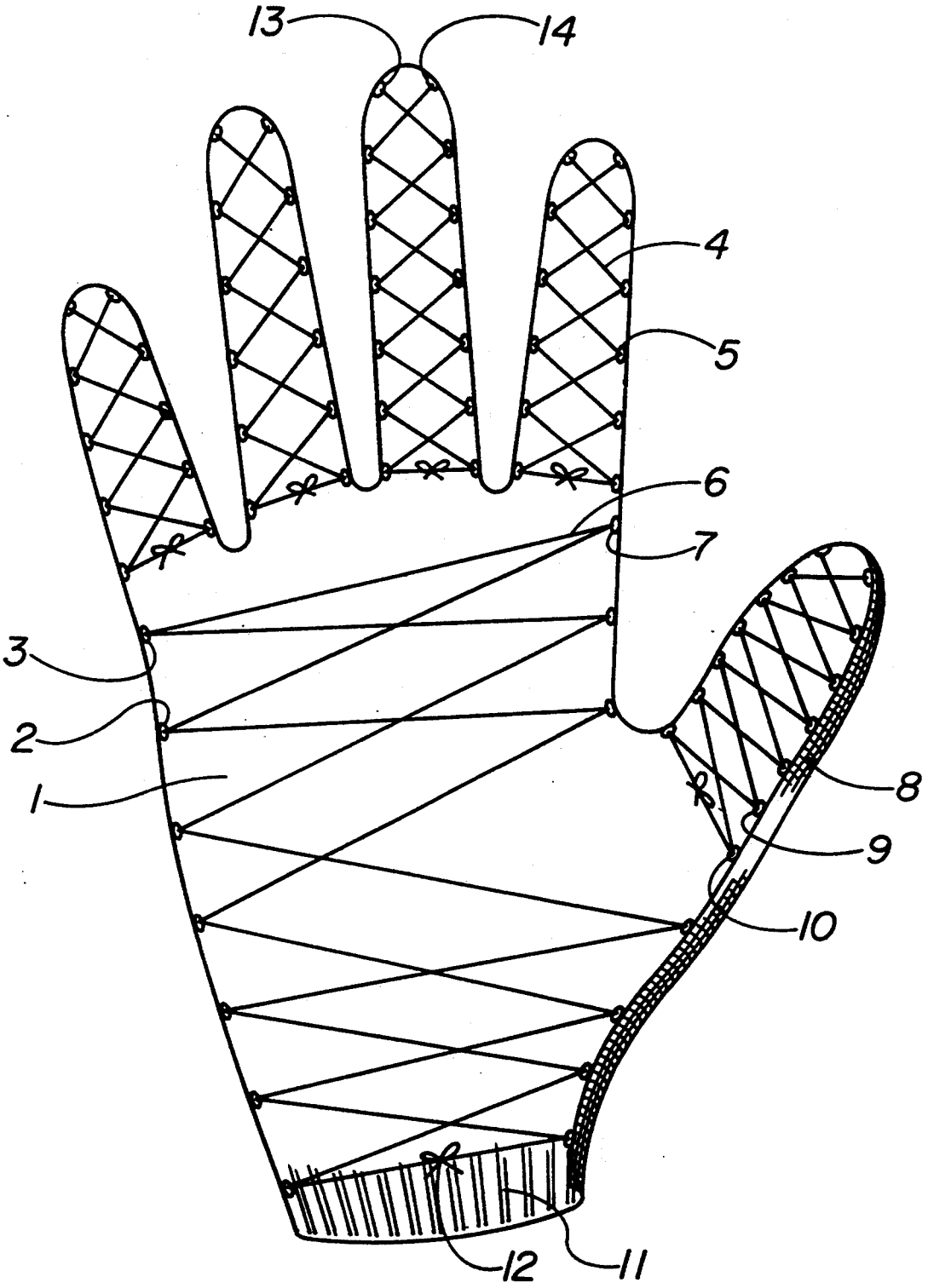
FIG. 1 through FIG. 10 are each a frontal perspective view of several preferred embodiments of the device in accordance with my invention. Each is a view of the device as it would appear as one were about to put it on one's right hand with the palm of the hand toward the viewer and with the fingers of the hand pointing upward. Each drawing shows in the foreground the side of the glove-like device which would cover the palm side of the hand, and in the background, looking through the spaces in the portions which cover the palm side of the hand, one can see the side of the sun-shield which would be against the back of the hand. The portions which would come across the palm of the hand and the palm side of the wrist and the palm side of each finger and thumb assist in holding the sun-shield on the hand.

Referring to FIG. 1, a sun-shielding, ventilated, glove-like device which is worn on the hand of a person, includes an inside portion 1 which lays near or against the skin on the back of the hand, the back of the fingers and thumb, and the back of the wrist. The other side of the device, the outside portion 8, is partially shown as it would come around the side of the thumb to cover the thumb's side. This outside portion 8 is exposed to the sunlight when the sun-shield is being worn on the hand.

The inside portion 1 and the outside portion 8, as shown are the opposite sides of one layer of material. However, this portion of the device could be constructed of more than one layer. The layer of material, as shown, shows no spaces in it for any ventilation through the material. However, loosly woven, but still sun-shielding, material which provided significant additional ventilation could be used. Similarly, if a material such as leather was used, slits could be cut in the layer to allow some air through, but still restrict the passage of an undesirable amount of sunlight.

The sun-shield is held on the hand by strings, laces, or thongs which go around three sides of each of the fingers and thumb and across the palm side of the hand when it is placed inside the glove. Strings 4 and 8 are shown respectively going across a finger and the palm. The strings are laced through eyelets in the outer edge of the sun-shield, such as eyelets 2 and 9, and press against the outside edge of the eyelets as shown at eyelets 3, 5, 7, and 10. Each of the strings can be tightened around the fingers and the palm by pulling the loose ends and tying the loose ends in a knot such as knot 12. Elastic 11 is shown incorporated into the sun-shield at the location where the sun-shield covers the back of the wrist. Each of the strings crossing over the fingers and thumb is shown attached, at its stationary end, to the edges of the sun-shield at attaching points such as attaching points 13 and 14. However, the strings could be attached to or laced through eyelets at these points if that were desired and eyelets were added.

The elastic portion 11 stretches when the fingers are bent, and thus enables the wearer to easily bend the fingers without restriction. This elastic portion is optional and is unnecessary if the glove is worn loosely, or if the sun-shield is being worn in situations which do not require that it be held tightly on the hand.

Figure 2:
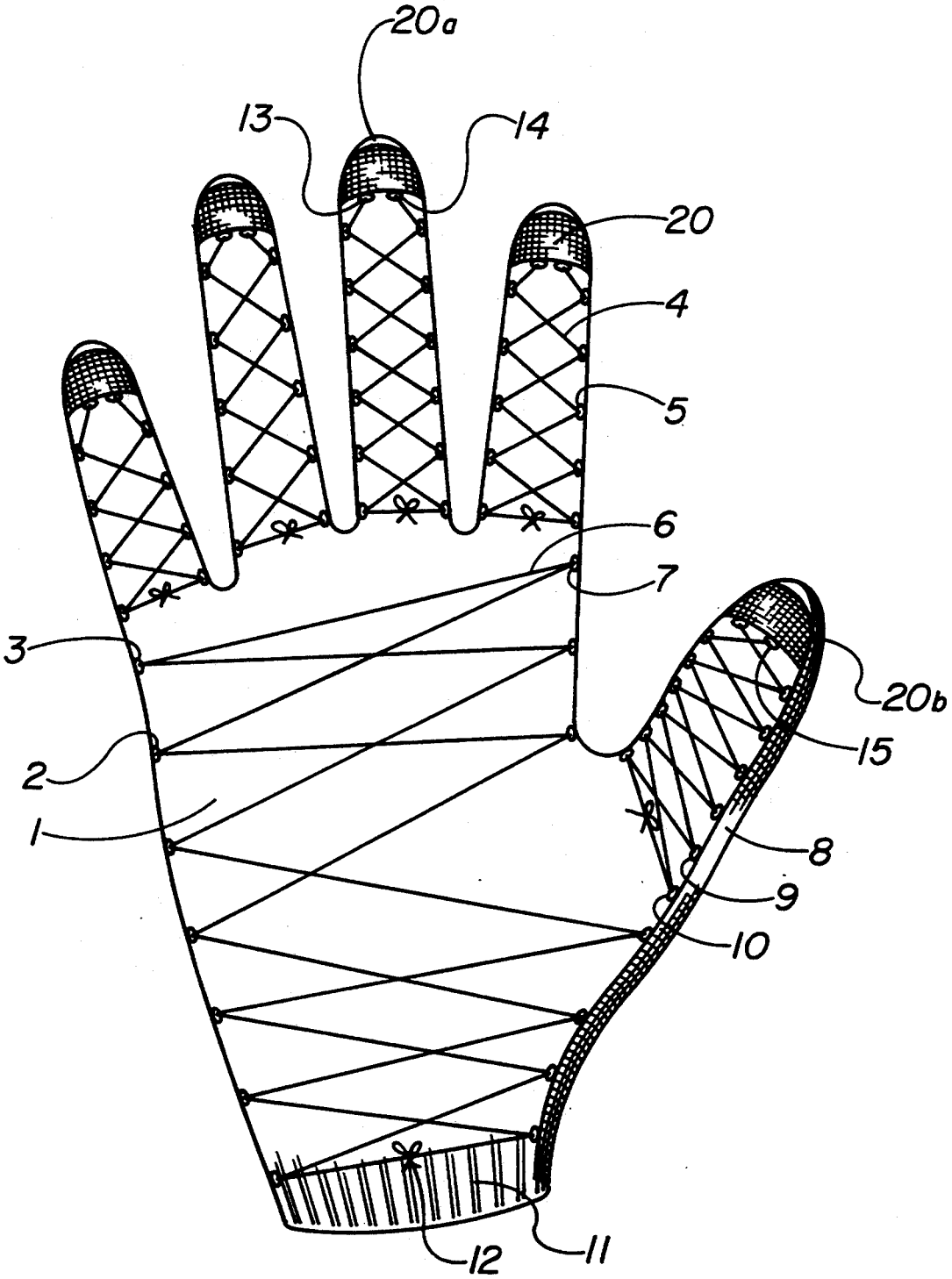

Referring now to FIG. 2. a sun-shielding, ventilated, glove-like device which is the same as FIG. 1, except that there has been added fingertip portions such as fingertip portion 20 which wrap around each of the fingertips and the tip of the thumb. These fingertip portions are attached to the side edges of the sun-shield as can be seen at point of attachment **20*b* on the thumb covering portion of the sun-shield. Eyelets, such as eyelet 15** on the portion covering the tip of the thumb, can be added to each portion covering the tips of the fingers and the tip of the thumb, and strings can be attached to the eyelets or a single string can be run through them.

Slits **20*a*** in the portions covering the tips of the fingers and the tip of the thumb allow the fingernails to come through the portion covering the tips of the fingers. This is especially useful for people with long fingernails.

Figure 3:
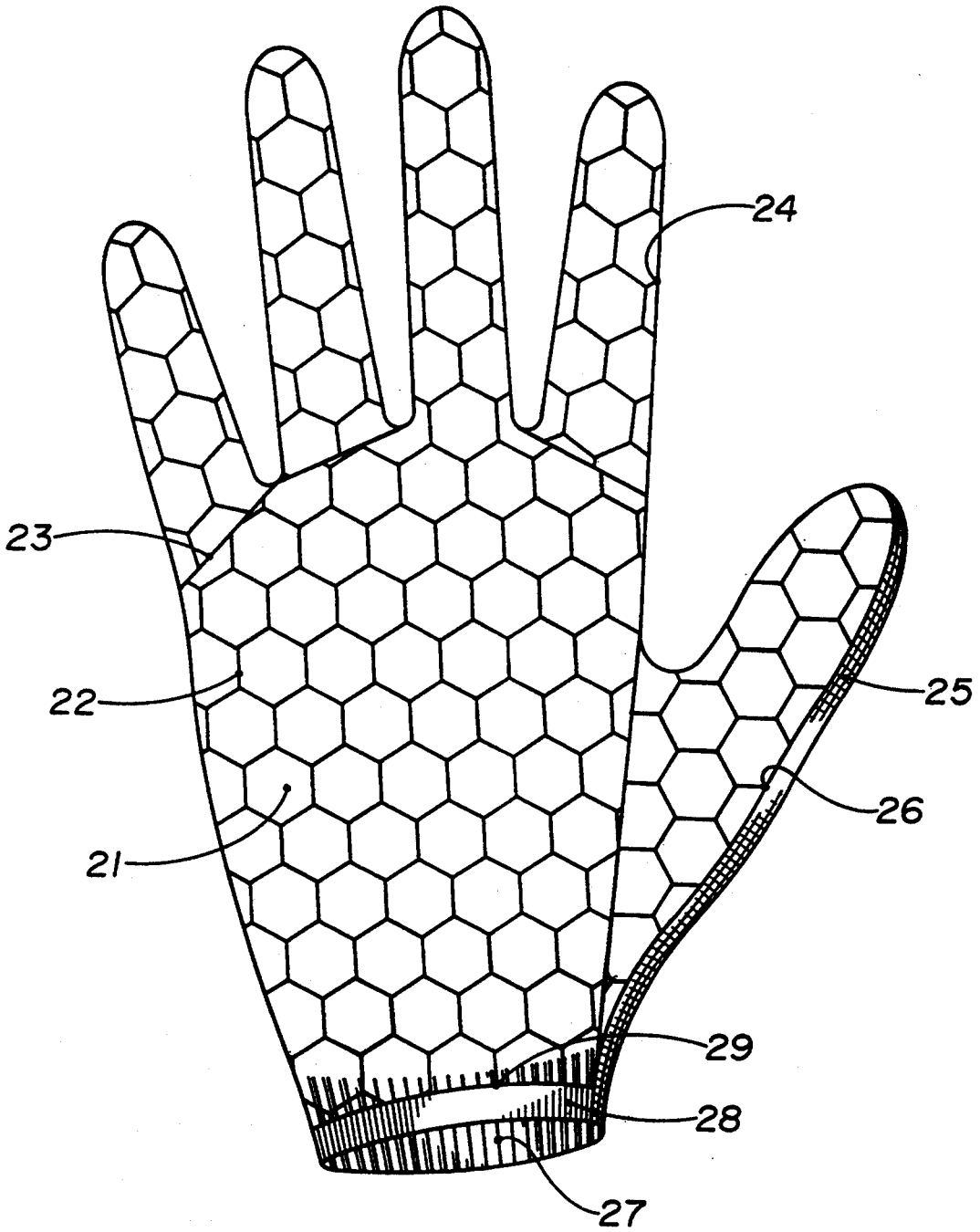

Referring to FIG. 3, a sun-shielding, ventilated, glove-like device which is worn on the hand of a person, includes an inside portion 21 which lays near or against the skin on the back of the hand, the back of the fingers and thumb, and the back of the wrist. The other side of the device, the outside portion 25, is partially shown as it would come around the side of the thumb to cover the thumb's side. This outside portion 25 is exposed to the sunlight when the sun-shield is being worn on the hand.

The inside portion 21 and the outside portion 25, as shown are the opposite sides of one layer of material. However, this portion of the device could be constructed of more than one layer. The layer of material, as shown, shows no spaces in it for any ventilation through the material. However, loosly woven, but still sun-shielding, material which provided significant additional ventilation could be used. Similarly, if a material such as leather was used, slits could be cut in the layer to allow some air through, but still restrict the passage of an undesirable amount of sunlight.

The sun-shield is held on the hand by a network of strings or netting 22 which, as shown here, is a series of hexagons, which go around three sides of each of the fingers and thumb and across the palm side of the hand when it is placed inside the glove. Netting 22 which is part of the hexagon shaped netting covering the palm is joined to the netting covering the fingers by attachment to string 23. The netting 22 is attached to the edges of the sun-shield at numerous points such as attachment points 24 and 26. Band 28 also goes across the palm side of the wrist and is joined to the two edges of the wrist covering part of the sun-shield. Netting 22 is attached to band 28 at points such as attachment point 29. Elastic 27 is shown incorporated into the sun-shield at the location where the sun-shield covers the back of the wrist.

The elastic portion 27 stretches when the fingers are bent, and thus enables the wearer to easily bend the fingers without restriction. This elastic portion is optional and is unnecessary if the glove is worn loosely, or if the sun-shield is being worn in situations which do not require that it be held tightly on the hand.

Figure 4:
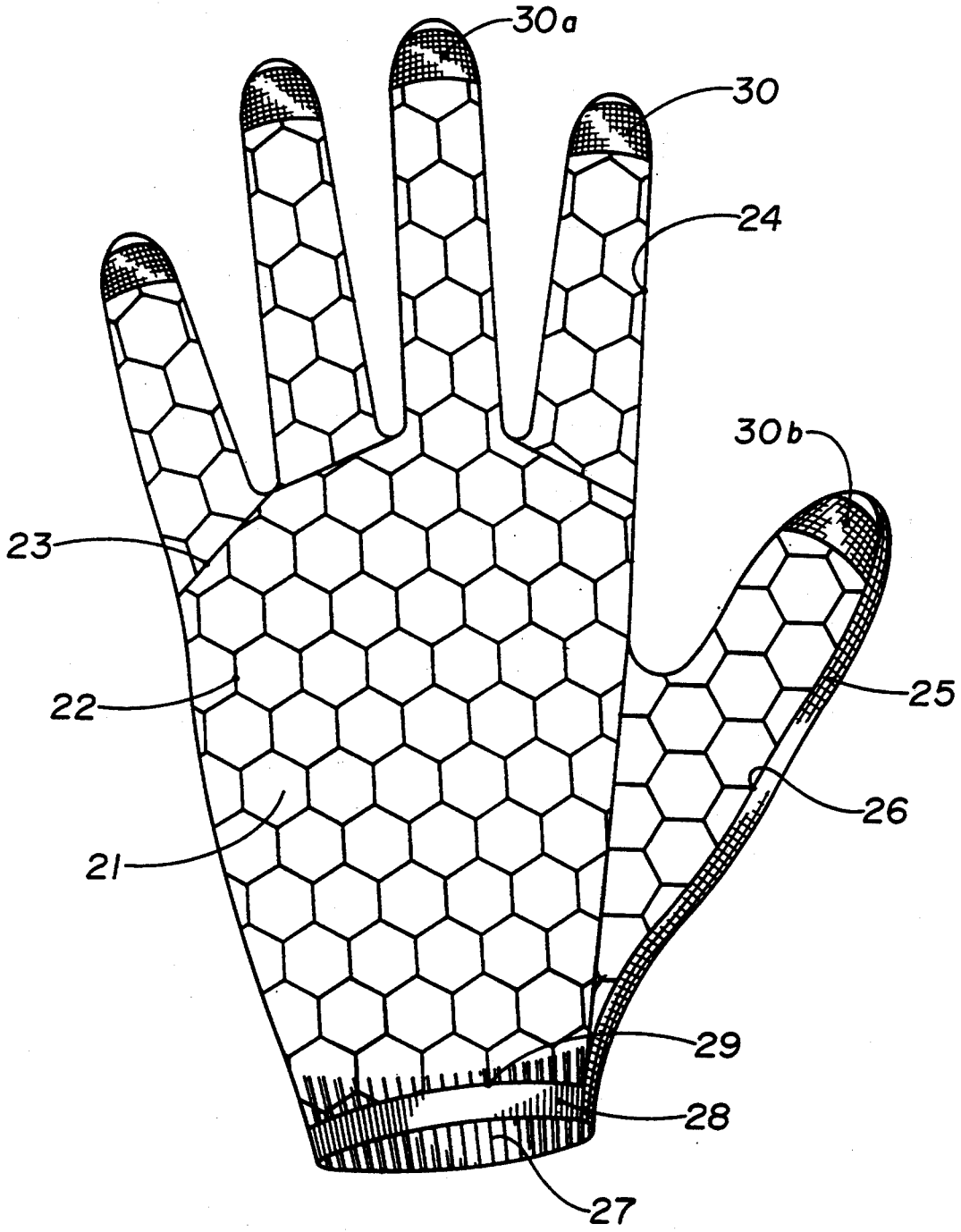

Referring now to FIG. 4, a sun-shielding, ventilated, glove-like device which is the same as FIG. 3, except that there has been added fingertip portions, such as fingertip portion 30, which wrap around each of the fingertips and the tip of the thumb. These fingertip portions are attached to the side edges of the sun-shield as can be seen at point of attachment **30*b*** on the thumb covering portion of the sun-shield.

Slits **30*a*** in the portions covering the tips of the fingers and the tip of the thumb allow the fingernails to come through the portion covering the tips of the fingers. This is especially useful for people with long fingernails.

Figure 5:
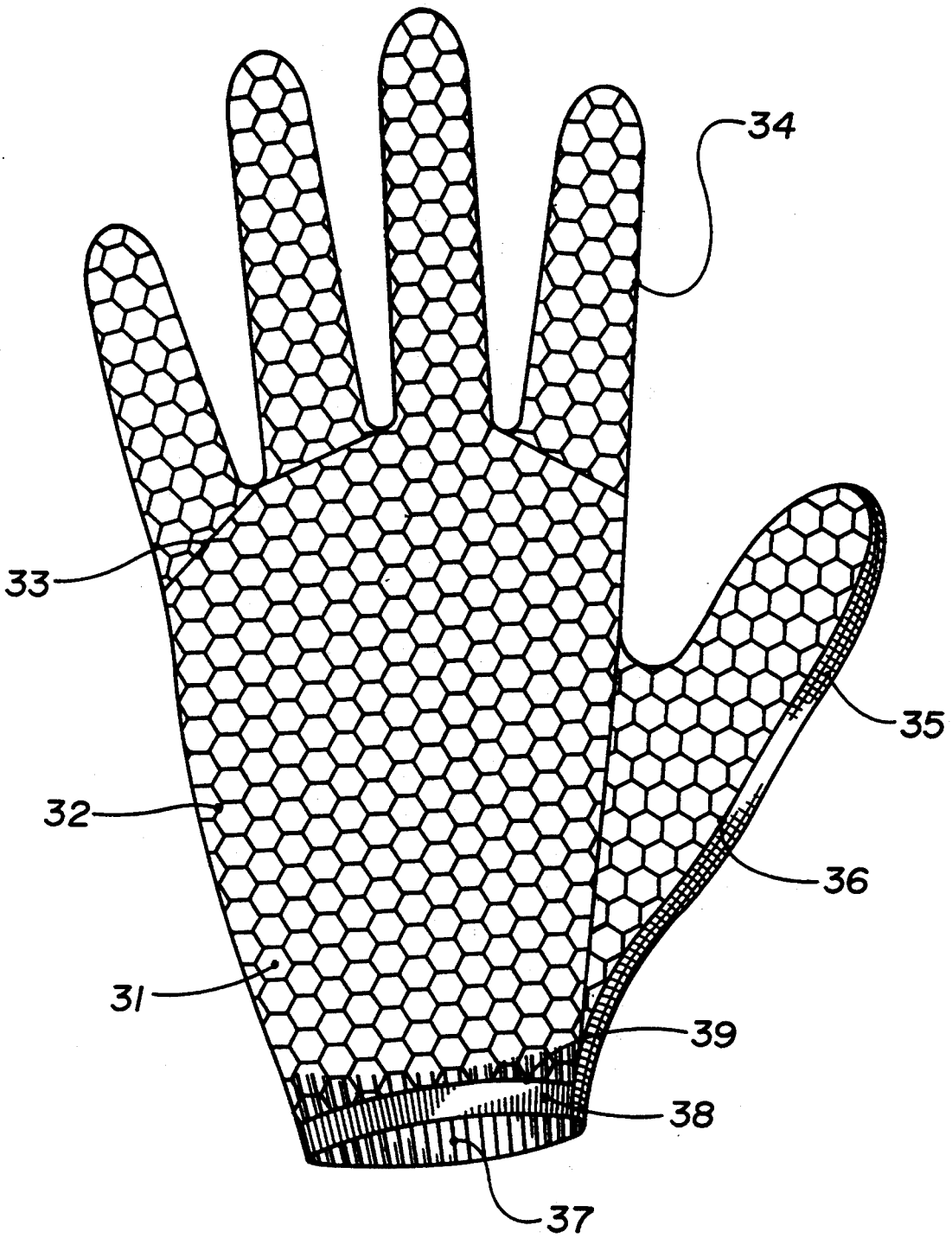

Referring to FIG. 5, a sun-shielding, ventilated, glove-like device which is worn on the hand of a person, includes an inside portion 31 which lays near or against the skin on the back of the hand, the back of the fingers and thumb, and the back of the wrist. The other side of the device, the outside portion 35, is partially shown as it would come around the side of the thumb to cover the thumb's side. This outside portion 35 is exposed to the sunlight when the sun-shield is being worn on the hand.

The inside portion 31 and the outside portion 35, as shown are the opposite sides of one layer of material. However, this portion of the device could be constructed of more than one layer. The layer of material, as shown, shows no spaces in it for any ventilation through the material. However, loosly woven, but still sun-shielding, material which provided significant additional ventilation could be used. Similarly, if a material such as leather was used, slits could be cut in the layer to allow some air through, but still restrict the passage of an undesirable amount of sunlight.

The sun-shield is held on the hand by a network of strings or netting 32 which, as shown here, is a series of hexagons, which hexagons are smaller in size than those shown in FIG. 3, and which go around three sides of each of the fingers and thumb and across the palm side of the hand when it is placed inside the glove. Netting 32 which is part of the hexagon shaped netting covering the palm is joined to the netting covering the fingers by attachment to string 33. The netting 32 is attached to the edges of the sun-shield at numerous points such as attachment points 34 and 36. Band 38 also goes across the palm side of the wrist and is joined to the two edges of the wrist covering part of the sun-shield. Netting 32 is attached to band 38 at points such as attachment point 39. Elastic 37 is shown incorporated into the sun-shield at the location where the sun-shield covers the back of the wrist.

The elastic portion 37 stretches when the fingers are bent, and thus enables the wearer to easily bend the fingers without restriction. This elastic portion is optional and is unnecessary if the glove is worn loosely, or if the sun-shield is being worn in situations which do not require that it be held tightly on the hand.

Figure 6:
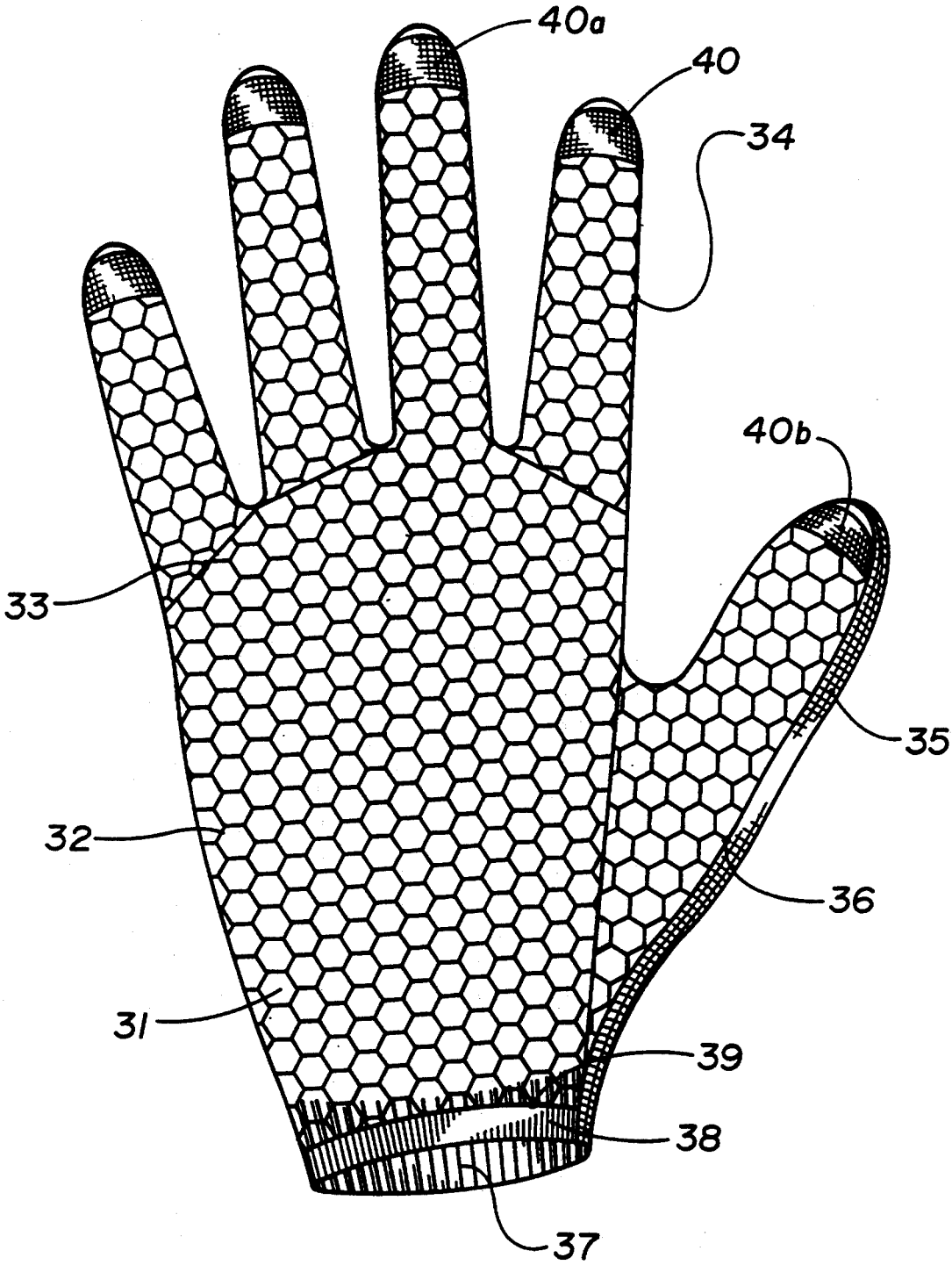

Referring now to FIG. 6, a sun-shielding, ventilated, glove-like device which is the same as FIG. 5, except that there has been added fingertip portions, such as fingertip portion 40, which wrap around each of the fingertips and the tip of the thumb. These fingertip portions are attached to the side edges of the sun-shield as can be seen at point of attachment **40*b*** on the thumb covering portion of the sun-shield.

Slits **40*a*** in the portions covering the tips of the fingers and the tip of the thumb allow the fingernails to come through the portion covering the tips of the fingers. This is especially useful for people with long fingernails.

Figure 7:
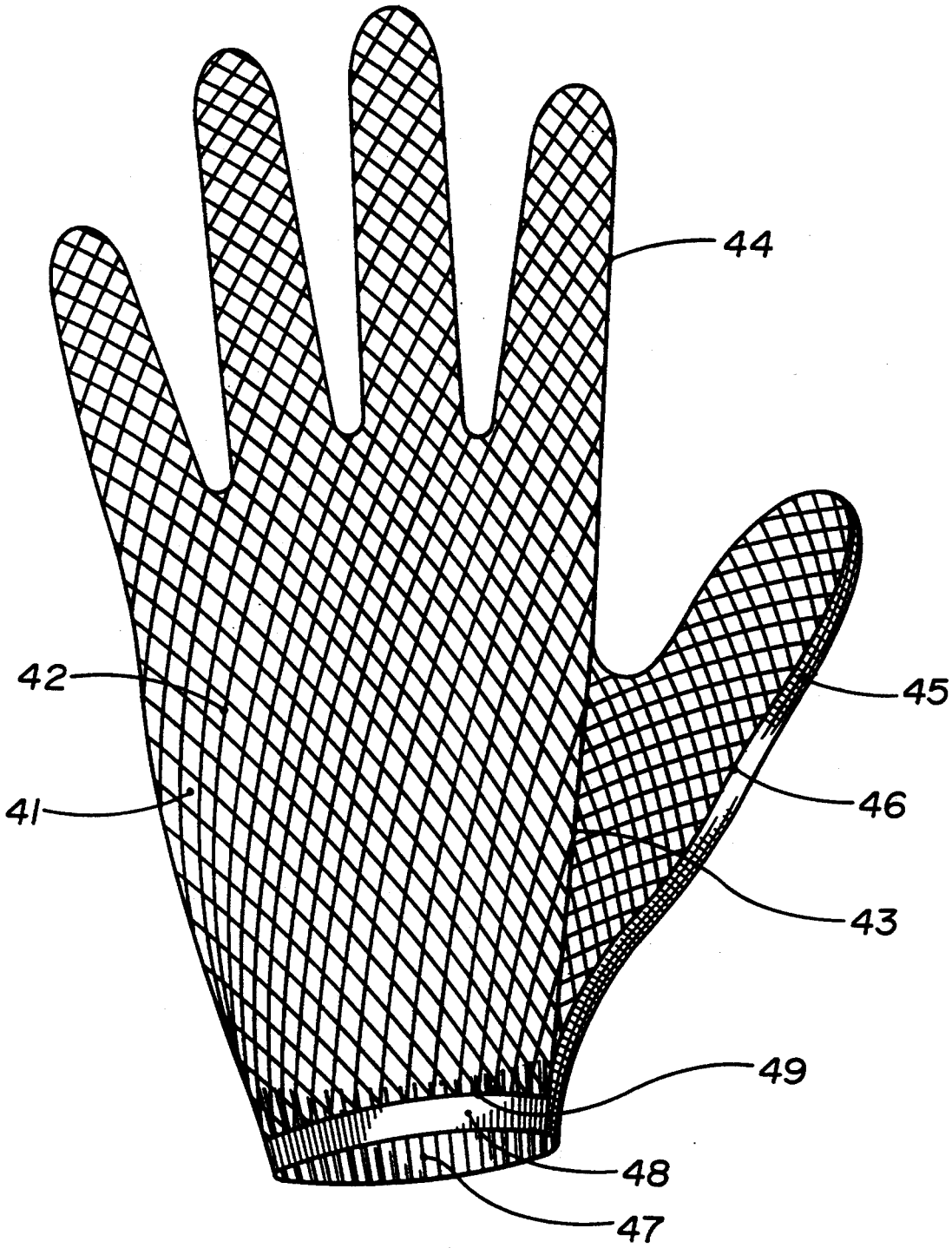

Referring to FIG. 7, a sun-shielding, ventilated, glove-like device which is worn on the hand of a person, includes an inside portion 41 which lays near or against the skin on the back of the hand, the back of the fingers and thumb, and the back of the wrist. The other side of the device, the outside portion 45, is partially shown as it would come around the side of the thumb to cover the thumb's side. This outside portion 45 is exposed to the sunlight when the sun-shield is being worn on the hand.

The inside portion 41 and the outside portion 45, as shown are the opposite sides of one layer of material. However, this portion of the device could be constructed of more than one layer. The layer of material, as shown, shows no spaces in it for any ventilation through the material. However, loosly woven, but still sun-shielding, material which provided significant additional ventilation could be used. Similarly, if a material such as leather was used, slits could be cut in the layer to allow some air through, but still restrict the passage of an undesirable amount of sunlight.

The sun-shield is held on the hand by a network of strings or netting 42 which, as shown here, is a series of diamond shaped polygons, squares, parallelograms, and/or other shapes, formed by the intersections of the strings, which go around three sides of each of the fingers and thumb and across the palm side of the hand when it is placed inside the glove. Netting 42 which is part of the polygon shaped netting covering the palm is joined to the netting covering the thumb by attachment to string 43. The netting 42 is attached to the edges of the sun-shield at numerous points such as attachment points 44 and 46. Band 48 also goes across the palm side of the wrist and is joined to the two edges of the wrist covering part of the sun-shield. Netting 42 is attached to band 48 at points such as attachment point 49. Elastic 47 is shown incorporated into the sun-shield at the location where the sun-shield covers the back of the wrist.

The elastic portion 47 stretches when the fingers are bent, and thus enables the wearer to easily bend the fingers without restriction. This elastic portion is optional and is unnecessary if the glove is worn loosely, or if the sun-shield is being worn in situations which do not require that it be held tightly on the hand.

Figure 8:
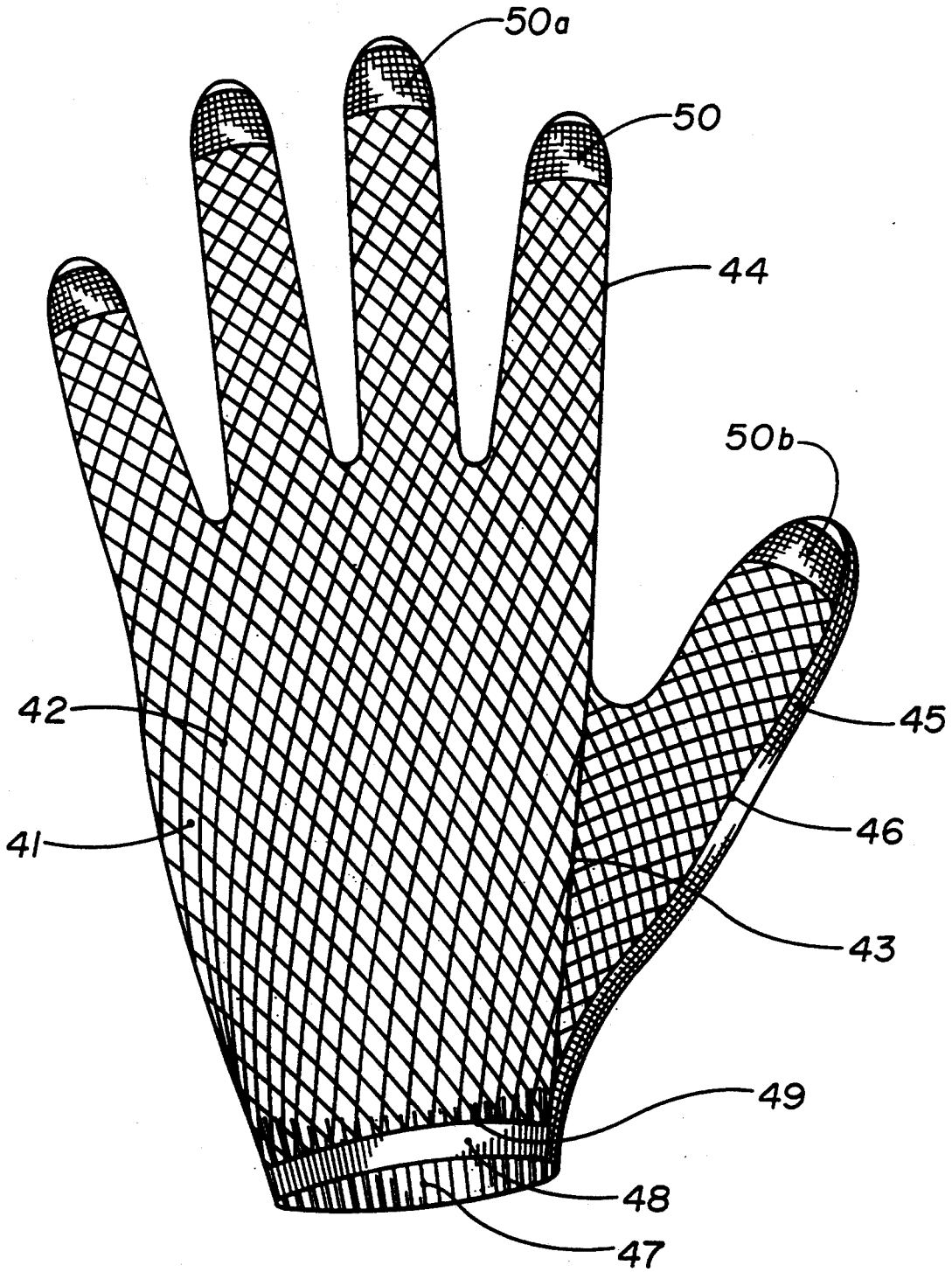

Referring now to FIG. 8, a sun-shielding, ventilated, glove-like device which is the same as FIG. 7, except that there has been added fingertip portions, such as fingertip portion 50, which wrap around each of the fingertips and the tip of the thumb. These fingertip portions are attached to the side edges of the sun-shield as can be seen at point of attachment **50*b*** on the thumb covering portion of the sun-shield.

Slits **50*a*** in the portions covering the tips of the fingers and the tip of the thumb allow the fingernails to come through the portion covering the tips of the fingers. This is especially useful for people with long fingernails.

Figure 9:
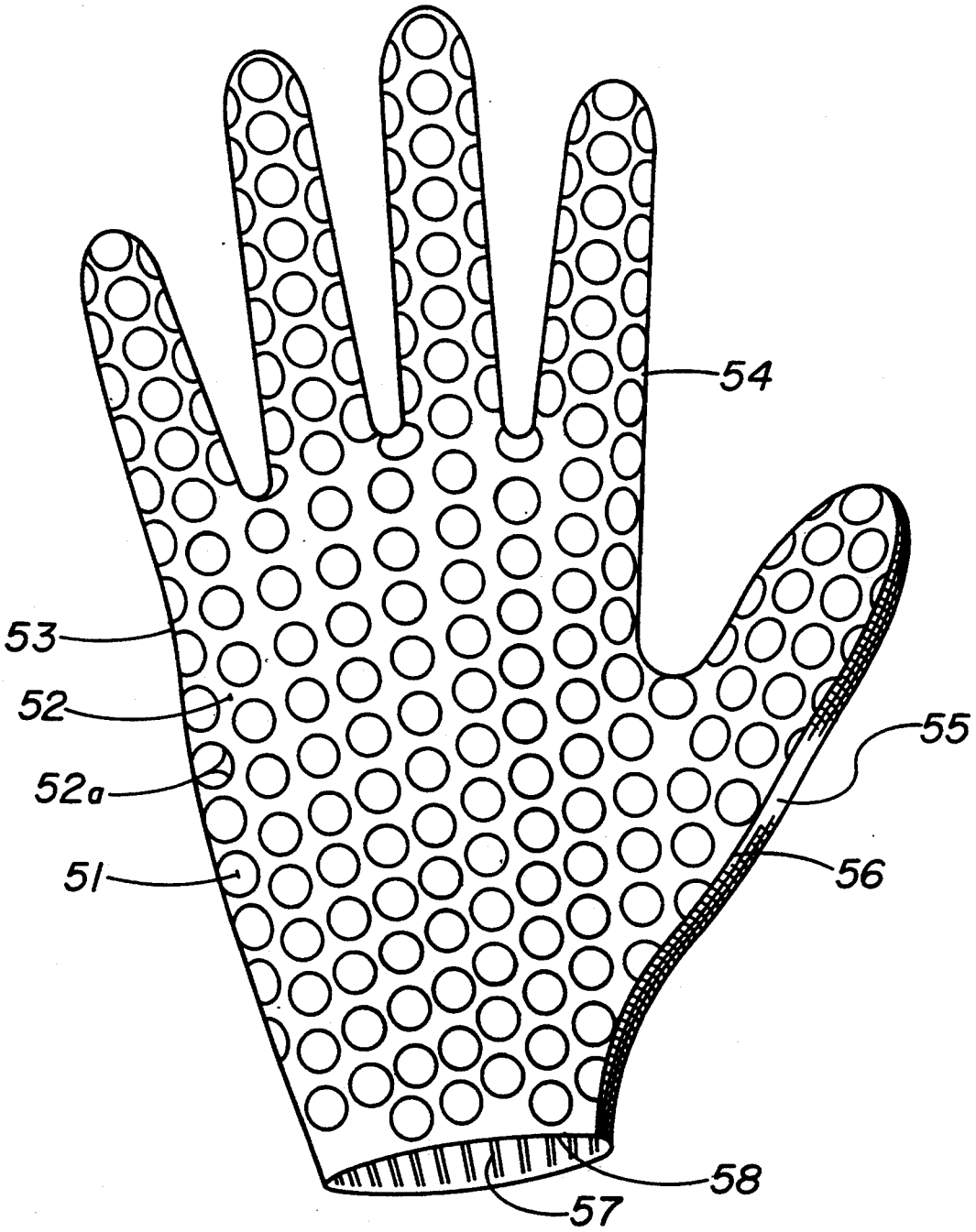

Referring to FIG. 9, a sun-shielding, ventilated, glove-like device which is worn on the hand of a person, includes an inside portion 51 which lays near or against the skin on the back of the hand, the back of the fingers and thumb, and the back of the wrist. The other side of the device, the outside portion 55, is partially shown as it would come around the side of the thumb to cover the thumb's side. This outside portion 55 is exposed to the sunlight when the sun-shield is being worn on the hand.

The inside portion 51 and the outside portion 55, as shown are the opposite sides of one layer of material. However, this portion of the device could be constructed of more than one layer. The layer of material, as shown, shows no spaces in it for any ventilation through the material. However, loosly woven, but still sun-shielding, material which provided significant additional ventilation could be used. Similarly, if a material such as leather was used, slits could be cut in the layer to allow some air through, but still restrict the passage of an undesirable amount of sunlight.

The sun-shield is held on the hand by another layer of material, layer 52, which is separated from inside portion 51 by enough space so a hand can be inserted between layer 52 and inside portion 51. Layer 52 goes around three sides of each of the fingers and thumb and across the palm side of the hand when the hand is placed inside the glove. Layer 52 can be a film-like material such as leather hide or it can be a cloth-like woven material. Layer 52 is perforated by circular openings, such as ventilation opening **52*a*, which allow air to flow through to the palm of the hand of the wearer and also allow heat to escape from the palm side of the hand of the wearer. The ventilation openings shown here are circular, but they can be of any shape. All edges of layer 52 except edge 58 are attached to corresponding edges of the sun-shield at numerous points such as attachment points 53, 54, and 56. Elastic 57 is shown incorporated into the sun-shield at the location where the sun-shield covers the back of the wrist. One edge, edge 58, of layer 52 is shown separated from the inside portion 51** of the sun shield at the location where the wearer's hand would be inserted into the glove and is also the same location where the wearer's wrist would be when the hand was fullly inserted into the glove.

The elastic portion 57 stretches when the fingers are bent, and thus enables the wearer to easily bend the fingers without restriction. This elastic portion is optional and is unnecessary if the glove is worn loosely, or if the sun-shield is being worn in situations which do not require that it be held tightly on the hand.

Figure 10:
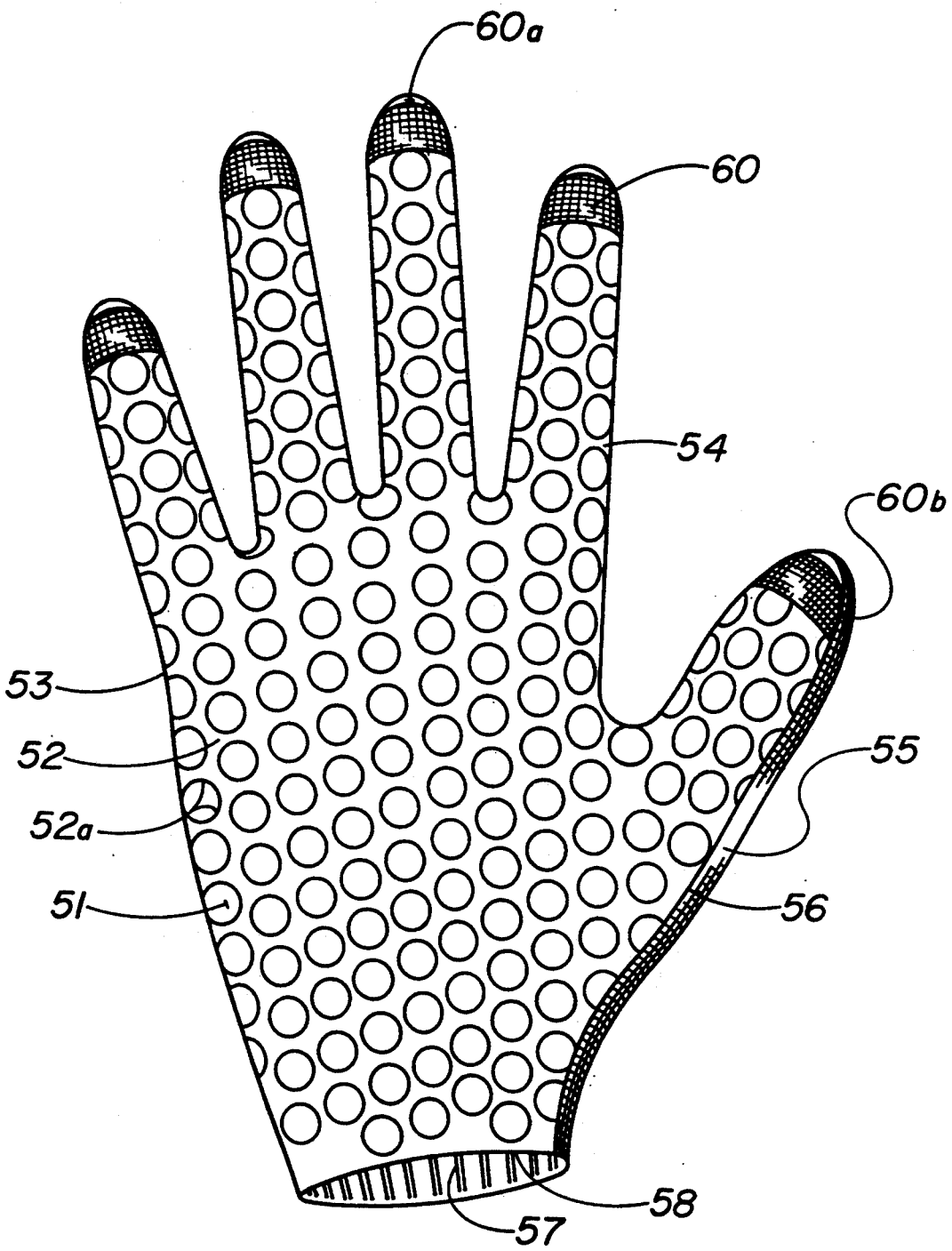

Referring now to FIG. 10, a sun-shielding, ventilated, glove-like device which is the same as FIG. 9, except that there has been added fingertip portions, such as fingertip portion 60, which wrap around each of the fingertips and the tip of the thumb. These fingertip portions are attached to the side edges of the sun-shield as can be seen at point of attachment **60*b*** on the thumb covering portion of the sun-shield.

Slits **60*a*** in the portions covering the tips of the fingers and the tip of the thumb allow the fingernails to come through the portion covering the tips of the fingers. This is especially useful for people with long fingernails.

It is to be understood that the foregoing description relates to exemplary embodiments and variants of my invention set out by way of example, not by way of limitation. Numerous other embodiments and variants are possible without departing from the spirit and scope of the invention, its scope being defined in the appended claims.

I claim:

1. A sun-shielding device for protecting a wearer's hand having a back and a palm, four fingers and a thumb, said device having a hand portion, four finger portions, a thumb portion and a wrist portion, said thumb and finger portions each having a proximate end where they join the hand portion and a distal end proximate a wearer's fingertips when the device is placed on a wearer's hand, said device comprising a sun-shielding portion and attachment portions which aid in holding the sun-shielding portion on the hand, said sun-shielding portion being made of material which impedes the passage of light and radiation from the sun and sized and shaped to entirely cover only the back of the wearer's hand, the backs of the wearer's fingers and thumb, and the back of the wearer's wrist, each of the portions covering the back of the wearer's hand, the backs of the fingers and the thumb and the back of the wrist having first and second side edges; and an attachment portion being a band which goes across the palm side of the wrist, said band having two ends, wherein it is attached at one of its two ends to the first side edge of the wrist portion of the sun-shielding portion and the other end is attached to the second side edge of the wrist portion of the sun-shielding portion, wherein the band and the wrist portion of the sun-shield to which the band is attached can wrap around a wearer's wrist to form a closed circle through which the hand can be inserted into the glove and, when the sun-shielding device is donned by a wearer, the band crosses over the palm side of the wearer's wrist, and other attachment portions being string netting having hexagonal shaped openings therein and such hexagonal openings being no smaller than one-eighth inch across at their smallest dimension, and this string netting being attached to the sun-shielding portion at the first and second side edges of each of the portions covering the back of the wearer's hand, the backs of the fingers and thumb and the back of the wrist, and also being attached to the band which goes across the palm side of the wrist; whereby, when the sun-shielding device is donned by a wearer, the palm side of the wearer's hand, fingers, thumb and wrist are covered only by the attachment portions.

2. A sun-shielding device according to claim 1 wherein there is added to each finger and thumb covering portion, at its distal end on the palm covering sides, an attachment portion which is a cap which encloses the tip of a finger or thumb and extends from the distal end toward the proximal end, terminating at a point about one-half inch from the distal end, and which is attached to the two side edges of the finger or thumb covering portions of the sun-shield, and the string netting for each of the finger and thumb attachment portions is attached to each respective cap at its edge away from the distal end.

3. A sun-shielding device according to claim 1 wherein there is added to each finger and thumb covering portion, at its distal end on the palm covering sides, an attachment portion which is a cap, made of a flexible cloth-like material, which encloses the tip of a finger or thumb and extends from the distal end toward the proximal end, terminating at a point about one-half inch from the distal end, and which is attached to the two side edges of the finger or thumb covering portions of the sun-shield, and the string netting for each of the finger and thumb attachment portions is attached to each respective cap at its edge away from the distal end.

4. A sun-shielding device according to claim 1 wherein the sun-shielding portion is made of a flexible cloth-like material which impedes the passage of light and radiation from the sun.

5. A sun-shielding device according to claim 1 wherein the sun-shielding portion is made of a flexible film of material which impedes the passage of light and radiation from the sun.

6. A sun-shielding device for protecting a wearer's hand having a back and a palm, four fingers and a thumb, said device having a hand portion, four finger portions, a thumb portion and a wrist portion, said thumb and finger portions each having a proximate end where they join the hand portion and a distal end proximate a wearer's fingertips when the device is placed on a wearer's hand, said device comprising a sun-shielding portion and attachment portions which aid in holding the sun-shielding portion on the hand, said sun-shielding portion being made of material which impedes the passage of light and radiation from the sun and sized and shaped to entirely cover only the back of the wearer's hand, the backs of the wearer's fingers and thumb, and the back of the wearer's wrist, each of the portions covering the back of the wearer's hand, the backs of the fingers and the thumb and the back of the wrist having first and second side edges; and an attachment portion being a band which goes across the palm side of the wrist, said band having two ends, wherein it is attached at one of its two ends to the first side edge of the wrist portion of the sun-shielding portion and the other end is attached to the second side edge of the wrist portion of the sun-shielding portion, wherein the band and the wrist portion of the sun-shield to which the band is attached can wrap around a wearer's wrist to form a closed circle through which the hand can be inserted into the glove and, when the sun-shielding device is donned by a wearer, the band crosses over the palm side of the wearer's wrist, and other attachment portions being string netting having square, diamond, or parallelogram shaped openings therein and such square, diamond, or parallelogram openings being no smaller than one-eighth inch across at their smallest dimension, and this string netting being attached to the sun-shielding portion at the first and second side edges of each of the portions covering the back of the wearer's hand, the backs of the fingers and thumb and the back of the wrist, and also being attached to the the band which goes across the palm side of the wrist; whereby, when the sun-shielding device is donned by a wearer, the palm side of the wearer's hand, fingers, thumb and wrist are covered only by the attachment portions.

7. A sun-shielding device according to claim 6 wherein there is added to each finger and thumb covering portion, at its distal end on the palm covering sides, an attachment portion which is a cap which encloses the tip of a finger or thumb and extends from the distal end toward the proximal end, terminating at a point about one-half inch from the distal end, and which is attached to the two side edges of the finger or thumb covering portions of the sun-shield, and the string netting for each of the finger and thumb attachment portions is attached to each respective cap at its edge away from the distal end.

8. A sun-shielding device according to claim 6 wherein there is added to each finger and thumb covering portion, at its distal end on the palm covering sides, an attachment portion which is a cap, made of a flexible cloth-like material, which encloses the tip of a finger or thumb and extends from the distal end toward the proximal end, terminating at a point about one-half inch from the distal end, and which is attached to the two side edges of the finger or thumb covering portions of the sun-shield, and the string netting for each of the finger and thumb attachment portions is attached to each respective cap at its edge away from the distal end.

9. A sun-shielding device according to claim 6 wherein the sun-shielding portion is made of a flexible cloth-like material which impedes the passage of light and radiation from the sun.

10. A sun-shielding device according to claim 6 wherein the sun-shielding portion is made of a flexible film of material which impedes the passage of light and radiation from the sun.

11. A sun-shielding device for protecting a wearer's hand having a back and a palm, four fingers and a thumb, said device having a hand portion, four finger portions, a thumb portion and a wrist portion, said thumb and finger portions each having a proximate end where they join the hand portion and a distal end proximate a wearer's fingertips when the device is placed on a wearer's hand, said device comprising a sun-shielding portion and attachment portions which aid in holding the sun-shielding portion on the hand, said sun-shielding portion being made of material which impedes the passage of light and radiation from the sun and sized and shaped to entirely cover only the back of the wearer's hand, the backs of the wearer's fingers and thumb, and the back of the wearer's wrist, each of the portions covering the back of the wearer's hand, the backs of the fingers and the thumb and the back of the wrist having first and second side edges; and an attachment portion being a band which goes across the palm side of the wrist, said band having two ends, wherein it is attached at one of its two ends to the first side edge of the wrist portion of the sun-shielding portion and the other end is attached to the second side edge of the wrist portion of the sun-shielding portion, wherein the band and the wrist portion of the sun-shield to which the band is attached can wrap around a wearer's wrist to form a closed circle through which the hand can be inserted into the glove and, when the sun-shielding device is donned by a wearer, the band crosses over the palm side of the wearer's wrist, and other attachment portions being string netting having circle, ellipse, polygon and/or other shaped openings therein and such circle, ellipse, polygon, and/or other shaped openings being no smaller than one-eighth inch across at their smallest dimension, and this string netting being attached to the sun-shielding portion at the first and second side edges of each of the portions covering the back of the wearer's hand, the backs of the fingers and thumb and the back of the wrist, and also being attached to the band which goes across the palm side of the wrist; whereby, when the sun-shielding device is donned by a wearer, the palm side of the wearer's hand, fingers, thumb and wrist are covered only by the attachment portions.

12. A sun-shielding device according to claim 11 wherein there is added to each finger and thumb covering portion, at its distal end on the palm covering sides, an attachment portion which is a cap which encloses the tip of a finger or thumb and extends from the distal end toward the proximal end, terminating at a point about one-half inch from the distal end, and which is attached to the two side edges of the finger or thumb covering portions of the sun-shield, and the string netting for each of the finger and thumb attachment portions is attached to each respective cap at its edge away from the distal end.

13. A sun-shielding device according to claim 11 wherein there is added to each finger and thumb covering portion, at its distal end on the palm covering sides, an attachment portion which is a cap, made of a flexible cloth-like material, which encloses the tip of a finger or thumb and extends from the distal end toward the proximal end, terminating at a point about one-half inch from the distal end, and which is attached to the two side edges of the finger or thumb covering portions of the sun-shield, and the string netting for each of the finger and thumb attachment portions is attached to each respective cap at its edge away from the distal end.

14. A sun-shielding device according to claim 11 wherein the sun-shielding portion is made of a flexible cloth-like material which impedes the passage of light and radiation from the sun.

15. A sun-shielding device according to claim 11 wherein the sun-shielding portion is made of a flexible film of material which impedes the passage of light and radiation from the sun.

* * * * *